United States Patent [19]

Aanonsen et al.

[11] 4,213,712

[45] Jul. 22, 1980

[54] METHOD AND APPARATUS FOR THE CONTINUOUS PRODUCTION OF A SLURRY EXPLOSIVE CONTAINING AN EMULSIFIED LIQUID COMPONENT

[75] Inventors: Bent Aanonsen; Paul-Johny Odberg, both of Saetre; Eirik Samuelsen, Lierbyen, all of Norway

[73] Assignee: Dyno Industries A.S., Oslo, Norway

[21] Appl. No.: 893,309

[22] Filed: Apr. 4, 1978

[30] Foreign Application Priority Data

Apr. 4, 1977 [NO] Norway ..... 771201
Mar. 13, 1978 [NO] Norway ..... 780885

[51] Int. Cl.[2] ..... B01F 7/08
[52] U.S. Cl. ..... 366/178; 366/280; 422/163
[58] Field of Search ..... 366/178, 280, 177, 150, 366/167, 168, 172; 422/163

[56] References Cited

U.S. PATENT DOCUMENTS

| | | | |
|---|---|---|---|
| 3,570,508 | 3/1971 | Boggs | 366/280 |
| 3,682,447 | 8/1972 | Zucker | 366/178 |
| 3,744,763 | 7/1973 | Zucker | 366/178 |
| 3,998,433 | 12/1976 | Iwako | 366/178 |
| 4,097,927 | 6/1978 | Sendov | 366/280 |

*Primary Examiner*—Robert W. Jenkins
*Attorney, Agent, or Firm*—Wenderoth, Lind & Ponack

[57] ABSTRACT

The continuous production of an explosive is achieved by intermixing at least two liquid component streams in an apparatus including a mixing rotor generally formed like a turbine impeller and freely rotatably supported in a housing directly opposite an inlet opening for one of the liquid components. The passing liquid stream imparts a rotational motion to the mixing rotor and the liquid components are effectively mixed by shear and turbulence in an annular narrow mixing zone between the outer periphery of the rotor and the inner wall of the housing. Preferably the entire surface of the mixing rotor is surrounded by the flowing liquid components, thus providing a low friction hydrostatic rotor support.

18 Claims, 6 Drawing Figures

METHOD AND APPARATUS FOR THE CONTINUOUS PRODUCTION OF A SLURRY EXPLOSIVE CONTAINING AN EMULSIFIED LIQUID COMPONENT

BACKGROUND OF THE INVENTION

The present invention relates to a method and apparatus for the continuous production of the type of explosive where the main constituents are an aqueous solution of salts which can yield oxygen (the salt solution) and a combustible liquid which is not soluble in the salt solution.

In the production of the type of explosive known as slurry, it is normal to use various salts which can yield oxygen, together with various fuels. The salts, normally ammonium nitrate and other nitrates, are present wholly or partially as a thickened, aqueous, normally pumpable solution, and the fuels may be solid or liquid and may be soluble or insoluble in water.

It has now become a well-established practice to produce these slurry explosives in situ, by mixing the salt solution continuously with the fuel and then pumping the explosive so formed directly into the boreholes. When the fuel is a particulate material, the mixing must take place in a mixer where the material is exposed to mechanical agitation. If the fuels are pumpable, either as homogenous liquids or as liquids with particulate matter dispersed therein, the mixer can be an apparatus known as a static mixer.

There are in principle two important advantages inherent in the use of a static mixer. The first is that the mixed explosive is not exposed to any mechanical mixing which can, in various types of abnormal working conditions, lead to undesired, uncontrolled and possibly dangerous heating of the explosive. The second is that the production equipment can be built as a completely closed system from the component pumps to the hose which is lowered into the borehole for loading the hole. In this way the need for a pump for the mixed explosive is avoided, and the risk of uncontrolled heating and the risks which result from the presence of a foreign object are eliminated.

The use of liquids which are insoluble in the salt solution comes into a special category. Fuel oil is the most typical of these liquids. Although these materials are inherently easier than particulate material to meter in a closed system, it is normally impossible to obtain an adequate dispersion of the liquid in the salt solution in a static mixer.

The flow conditions in the liquid in a static mixer are normally laminar, and this is not conducive to the formation of an emulsion, especially in salt solutions with relatively high viscosity. An extended dwell time in the mixer, and the creation of a large pressure drop across the mixer are measures known to improve the formation of an emulsion of one liquid in another, but these techniques must be considered undesirable or inappropriate for the production of explosives of the type under discussion here.

It has been necessary up to now to use mechanically driven mixing means even when using liquid fuels. This has implied that the disadvantages detailed above for the mixing of explosives containing particulate matter apply also to the mixing of explosives with liquid fuels.

SUMMARY OF THE INVENTION

The present invention consists in the use of the kinetic and/or pressure energy present in the salt solution to drive a mixing rotor, which in turn is used to form an emulsion of the insoluble liquid fuel in the salt solution.

The invention also includes an apparatus in which such a mixing rotor is free to rotate in a housing, and is equipped with blades which are acted upon by the stream of salt solution so that the rotor rotates. The mixing rotor and the housing are so shaped that sufficient shear forces and turbulence are created in the zones where the insoluble fuel component is brought together with the salt solution that an emulsion is formed. In this way a mixed detonatable explosive is produced rapidly and effectively without any unnecessary dwell time in the mixer, and also in a closed system to which a loading hose can be coupled. The continued rotation of the rotor will be dependent on the existence of both a flow of salt solution and also on an open discharge outlet for the mixed explosive. If either or both of these conditions ceases to exist, the rotation of the rotor will cease as will further production of detonatable explosive. This must be considered to have considerable bearing on safety.

Two embodiments of the invention are described, with reference to the accompanying schematic drawings. From these descriptions it will be clear that the invention can include more or fewer relevant details, in specially preferred embodiments, if this should be found to be desireable or advantageous.

The invention is however not limited to either of these embodiments, and it can in principle be achieved even when the details of construction deviate considerably from those shown here.

DETAILED DESCRIPTION OF THE INVENTION

Figure 1:
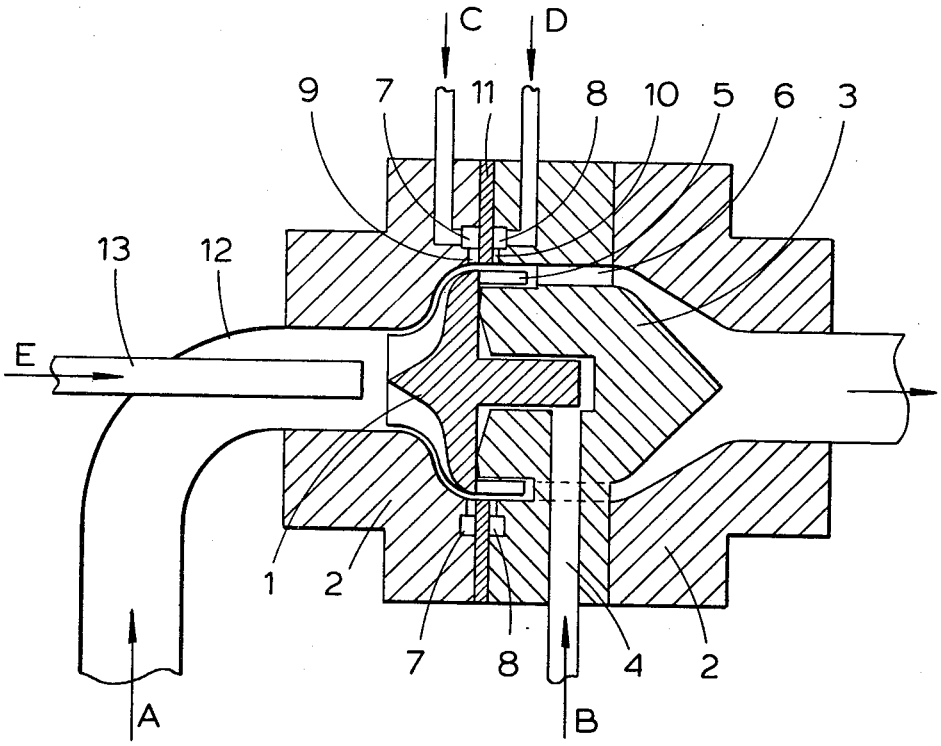
FIG. 1 is a cross sectional view of an embodiment of the invention.

In its general form the apparatus comprises a mixing rotor 1, FIG. 1, shaped like a turbine impeller, and a suitably shaped housing 2 in which the rotor can be set in rotation by a stream A of salt solution. Furthermore, the apparatus is so formed that an insoluble fuel B can be brought together with the salt solution in one or more zones where the shear forces and the turbulence in the salt solution are sufficient to emulsify the insoluble liquid fuel in the salt solution. However, the configuration of the apparatus is in no way limited to that shown in FIG. 1. Thus, the insoluble liquid fuel can equally well be introduced through passages in the housing 2 which surround the rotor or through the central stator 3 which is clearly necessary to support the rotor.

Figure 2A:
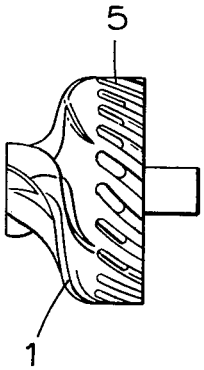
FIGS. 2*a* and 2*b* are a side view and a front view respectively of the mixing rotor of the embodiment shown in FIG. 1.
Figure 2B:
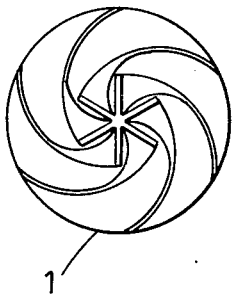

A possible embodiment of the mixing rotor is a shape which is essentially that of a radial turbine impeller, the greatest diameter of which is considerably more than the diameter of the inlet through which the salt solution will flow towards the front of the rotor. An increase in the velocity of the liquid is achieved by shaping the blades or vanes of the rotor, and the housing, so that the cross-section of the available flow area at the discharge from the rotor is considerably less than that at the entrance thereto. This is appropriate for both the function of the rotor as a turbine impeller and for the formation of the emulsion which will take place in the invention. One such construction is shown in FIG. 1, and the corresponding rotor is shown in FIGS. 2*a* and 2*b*.

Figure 3:
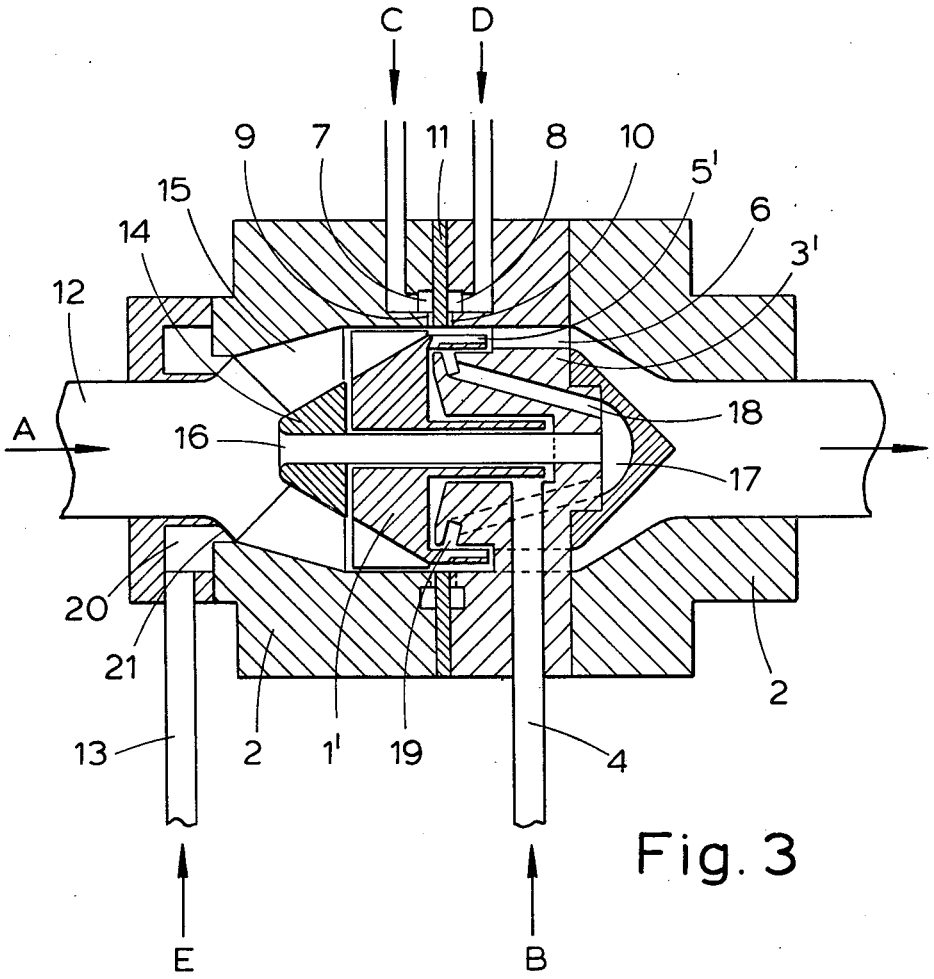
FIG. 3 is a cross sectional view of a second embodiment of the invention.
Figure 4A:
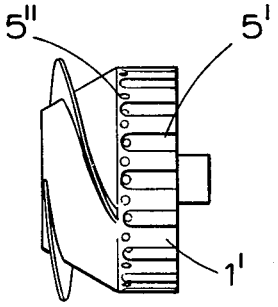
FIGS. 4*a* and 4*b* are a side view and a front view respectively of the mixing rotor of the embodiment shown in FIG. 3.
Figure 4B:
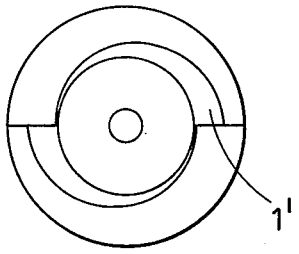

A second form for the part of the rotor that carries the blades is shown in FIG. 3 and FIGS. 4*a* and 4*b*. The shaping in this embodiment is that of an axial turbine impeller, and this is the preferred form when the salt solution is thickened so that it has a relatively high viscosity.

With these high viscosity salt solutions it has been found appropriate to reduce the cross-section of the area through which the salt solution flows in its passage over the rotor so that the velocity of the solution increases considerably. Preferably such cross-section is reduced with at least 80% along the rotor, resulting in a solution velocity increase of up to five times that at the entrance of the rotor.

It is also preferable to have the rotor hydrostatically supported, i.e. so that the thrust on the rotor on the inlet side is balanced by hydraulic pressure on the other side. This is obtained by arranging that the rotor runs in bearings which are in or on a stator 3 centrally located in the housing 2, and by arranging supply passages 4 in the housing for the insoluble liquid fuel, in such a manner that that components will flow over all the surfaces of the rotor which are not surrounded by salt solution. It is ensured in this way that the rotor runs with very low frictional resistance, and that the apparatus works effectively as long as the metering device for the insoluble liquid fuel is working. An additional advantage is obtained in the examples shown in the figures, as the pressure drop created by the flow of the salt solution over the rotor is taken up mainly by the insoluble liquid fuel as it flows out between the stator and the rotor. Because the layer of the insoluble liquid fuel is very thin, its velocity is very high and it is easier to obtain the desired emulsion.

A specially preferred embodiment is shown in FIG. 3 which ensures the formation of a good and complete emulsion of the insoluble liquid fuel which is used to achieve hydraulic balancing of the thrust of the rotor on its bearings. This embodiment consists in leading part of the salt solution axially through a circular passage 16 which is fixed relative to the stator 3' and which is mounted coaxially with the rotor 1'. The passage 16 leads to a chamber 17 in the stator, and the part of the salt solution which flows through this passage is led further through a multiplicity of passages 18 forwards through the stator to an annular port opening 19, which discharges into the mixing zone for the liquids near the surface over which the insoluble liquid fuel flows. In this way the insoluble liquid fuel is forced out against the part of the mixing rotor which creates turbulence, and this prevents the situation arising wherein the insoluble liquid fuel flows out of the mixing zone adherently along the surface of the stator without mixing.

Advantageously a flow divider 14 in the form of a truncate cone may be arranged in front of (i.e. upstreams of) the rotor 1 as shown in FIG. 3, when the rotor is of the axial turbine impeller type, and especially in the embodiment where part of the salt solution is led through a passage to the downstream side of the rotor as described above. The greater diameter of the flow divider should be approximately equal to the least diameter of the rotor. In this way, a favourable entrance for the salt solution onto the rotor is obtained, as are also the best possible pressure conditions for forcing part of the salt solution through the passages 16, 18 leading to the annular port 19.

For very highly viscous salt solutions it will also be advantageous to arrange that the stream of salt solution flows over a number of stationary guide blades 15 situated between the flow divider 14 and the inner wall of the housing 2, as shown in FIG. 3. In this way the speed of rotation of the rotor will be increased somewhat, and consequently the conditions in the mixing zone will be more conducive to the formation of an emulsion.

Other advantageous embodiments of the invention include other details designed to ease and intensify the process of forming the emulsion. Thus, an obvious embodiment consists of providing the rotor with a multiplicity of slots or pins round the periphery on that part of its surface where the two streams of liquids meet. Such a form is shown in FIG. 2*a*, which shows the rotor with a downstream crown of slots or grooves 5 formed at an angle to the axis of rotation.

For the embodiment illustrated in FIGS. 3, 4*a* and 4*b*, in which part of the salt solution is fed through the stator 3' to the annular port 19, it has been found specially advantageous to shape a downstream part of the mixing rotor like a skirt with a large number of alternating internal and external grooves 5' formed substantially parallel to the axis of the rotor. A corresponding number of apertures 5'' are formed in the skirt to allow for communicating the streams of liquids in the internal and external sides of the skirt. When this skirt rotates in the space between the housing 2 and the stator 3' with liquid supplied both internally and externally of the skirt, the grooves will create a highly turbulent flow pattern in the liquid stream, and apertures 5'' will permit the insoluble liquid fuel to come into contact with both the main stream of salt solution which passes over the turbine blades, and also the lesser amount which passes through the annular opening 19.

The turbulence in this zone can be further increased by providing the inner wall of the housing and the outer side of the stator with grooves (not shown).

Finally an advantageous feature would be to have the liquid flow, after having passed the zone in which it is intended that the emulsion will be formed, pass over a relatively large number of ribs or dividing walls 6. These serve both to support the stator 3 in the housing 2 and also to increase the shear forces and turbulence to a level higher than that which would exist if the opening for liquids was more unrestricted.

It is also a part of this invention to build into the apparatus construction details which make the apparatus especially applicable for the production of explosives which contain components additional to a salt solution and an insoluble liquid fuel.

It is well known that it is frequently desireable or essential to add to an explosive lesser amounts of a solution C which contains a crosslinking agent for the thickening agent in the salt solution. This is done to improve the water resistance of the explosive. It is also, in the same or other instances, desirable or essential to add lesser amounts of a solution D which contains a gassing agent. This causes the development in the explosive of the necessary degree of sensitivity. Normally, these agents must be added immediately before the explosive is pumped into the hole.

It is therefore preferable to construct the apparatus so that it can perform the functions of mixing in one or both of the solutions of the agents to the main stream of the explosive, in addition to achieving the main aim achieved by the embodiments described above.

It is especially suitable to form one or two supply passages 7, 8 in the housing, opening through several smaller apertures 9, 10 into or near the zone where the shear forces and the turbulence are greatest. It is a specially preferred embodiment to form a considerable part of the supply passage by dividing the housing in two parts in a plane normal to its axis at the point where the rotor has its greatest diameter, and to preform annular grooves in one or other of the flat surfaces so formed. A multiplicity of smaller apertures opening into the turbulent zones are conveniently formed by making small slots in the same surfaces. When two supply passages are required, an annular flat dividing plate 11 is mounted between the two parts of the housing 2. A specially simple, quick and effective mixing of the appropriate agents in the explosive is achieved with such an embodiment of the invention.

Finally, there is for special circumstances a preferred embodiment of the invention to make it possible to mix in to the explosive fuels other than the insoluble liquid fuel for which the invention is primarily designed. If these other components are liquids which are soluble in the salt solution, they can be brought together with the salt solution at any point upstream of the rotor of the device. If however the fuel consists of a particulate material, e.g. aluminum powder or other combustible powder, it has been found to be not only possible but also appropriate to add this in the form of a relatively highly viscous dispersion or paste. A thickened nitrate solution can be used as the dispersion medium, and the dispersion or paste must be such that it can be made to flow in an even stream with the help of metering devices such as screws, pumps, etc. Such high viscosity dispersions or pastes E can suitably be led axially towards the mixing rotor through a central inlet 13 in FIG. 1, while the salt solution is then led through an annular inlet 12 for the case in which the rotor does not have any axial passage.

If the rotor does have an axial passage, such as the passage 16 shown in FIG. 3, it is preferred to let the dispersion first enter through an annular port 20, FIG. 3, from where the dispersion is distributed evenly over the outer surface of the solution through one annular or through several smaller openings 21, FIG. 3. In this way it is ensured that the dispersed particles are not carried into the axial passage 16 in the rotor, as this could cause blocking of the chamber 17 or of the passages 18 in the stator.

The invention, as disclosed in the above description and accompanying drawings, is described in general and in some preferred forms for special purposes. The invention is not, however, limited to the forms shown in the drawings, in that the mixing rotor 3, the housing 2, and the method used to support the bearings for the rotor can be given a variety of extremely varied forms. The ports for the components in the explosive other than the salt solution and the insoluble liquid fuel can also be given other routes and shapes than those shown in the drawings, and all or some of them can also be omitted if this should be so desired.

Although the invention is aimed primarily at making possible the production of explosive in a closed system to which a loading house can be attached, it is not a precondition that the invention shall find application only at the place where the explosive shall be used, and where the explosive shall be led directly into the borehole. The invention can also be used advantageously where the explosive is produced in cartridges or in the form of other transportable units.

We claim:

1. A system for continuously producing an explosive in the form of an emulsion of at least two liquid components which are insoluble in each other by intermixing streams of said components, one of said components comprising an aqueous oxidizing salt solution, and another of said components comprising a combustible liquid, said system comprising:

a housing having an upstream end and a downstream end;

a mixing rotor freely rotatably supported within said housing, said rotor having an outer periphery facing an inner periphery of said housing and defining therewith an annular space;

said rotor including vanes facing said upstream end of said housing;

first inlet feed means extending into said upstream end of said housing for supplying therein a first stream of a first of said liquid components, and for directing said first stream against said vanes and past and around said rotor through said annular space toward said downstream end of said housing, thereby rotating said rotor;

second inlet feed means, extending into said housing between said upstream and downstream ends thereof, for supplying a second stream of a second of said liquid components into said annular space at a position to thereat join with said first stream;

said rotor having on said outer periphery thereof, downstream of said position, groove means for creating turbulence within said first and second streams and for thereby causing said first and second streams to form an emulsion; and outlet delivery means, extending from said housing at said downstream end thereof, for removing therefrom said emulsion.

2. A system as claimed in claim 1, wherein said first stream comprises a stream of said aqueous oxidizing salt solution, and said second stream comprises a stream of said combustible liquid.

3. A system as claimed in claims 1 or 2, further comprising a stator positioned within said housing, said rotor being freely rotatably supported by said stator by means of respective facing support surfaces thereof, and said second inlet feed means extending into said stator and delivering said second stream between said facing support surfaces and thereby forming a hydraulic supporting medium for said rotor.

4. A system as claimed in claim 1, wherein said first inlet feed means and said outlet delivery means are coaxially positioned at said upstream and downstream ends, respectively, of said housing.

5. A system as claimed in claim 4, wherein said rotor and vanes are substantially in the form of a radial turbine impeller.

6. A system as claimed in claim 5, wherein said groove means comprise inclined slots formed in said outer periphery of said rotor.

7. A system as claimed in claim 4, wherein said rotor and vanes are substantially in the form of an axial turbine impeller.

8. A system as claimed in claim 7, wherein said groove means comprise alternate internal and external axially extending grooves, and radial apertures extending through said rotor.

9. A system as claimed in claim 1, further comprising a plurality of dividing wall means, positioned within said housing downstream of said rotor, for increasing the shear and turbulence of said joined first and second streams.

10. A system as claimed in claim 1, further comprising at least one auxiliary supply passage, extending through said housing into said annular space at said position, for supplying at least one auxiliary component to said emulsion.

11. A system as claimed in claim 10, wherein said housing comprises two axially spaced parts having open-sided annular grooves therein, and further comprising a plate positioned between said parts and closing said annular grooves, separate said auxiliary supply passages extending into said annular grooves and from said annular grooves into said annular space.

12. A system as claimed in claim 1, further comprising auxiliary supply means for supplying an auxiliary component into said housing at said upstream end thereof.

13. A system as claimed in claim 12, wherein said auxiliary supply means comprises an axially centrally located pipe extending into said housing centrally of said first inlet feed means.

14. A system as claimed in claim 12, wherein said auxiliary supply means comprises an annular canal extending into said housing coaxially outwardly of said first inlet feed means.

15. A system as claimed in claim 1, wherein the internal cross-section of said housing decreases by at least 80% from a position immediately upstream of said vanes to said annular space.

16. A system as claimed in claim 1, further comprising a conical stationary flow divider positioned upstream of said rotor, aid flow divider having a maximum diameter equal to a minimum diameter of said rotor.

17. A system as claimed in claim 16, further comprising stationary guide blades fixedly attaching said flow divider to said housing.

18. A system as claimed in claim 1, further comprising a stator within said housing and supporting said rotor, said stator having therein a chamber downstream of said rotor, a passage extending axially through said rotor and communicating with said chamber, and plural passageways extending from said chamber through said stator to locations adjacent said position, whereby a portion of said first stream passes through said passage, said chamber, and said passageways to said position.

* * * * *